US005090864A

United States Patent [19]

Leifeld

[11] Patent Number: 5,090,864

[45] Date of Patent: Feb. 25, 1992

[54] METHOD OF OPENING FIBER BALES

[75] Inventor: Ferdinand Leifeld, Kempen, Fed. Rep. of Germany

[73] Assignee: Trützschler GmbH & Co. KG, Mönchengladbach, Fed. Rep. of Germany

[21] Appl. No.: 604,002

[22] Filed: Oct. 26, 1990

[30] Foreign Application Priority Data

Oct. 30, 1989 [DE] Fed. Rep. of Germany ..... 3936079

[51] Int. Cl.[5] ..... B65G 21/02

[52] U.S. Cl. ..... 414/412; 414/786

[58] Field of Search ..... 414/412, 786, 266–270, 414/560–561, 273, 275, 281, 282; 19/0.2, 80 R; 180/168; 198/507; 364/469, 470, 461

[56] References Cited

U.S. PATENT DOCUMENTS

| | | | |
|---|---|---|---|
| 4,510,646 | 4/1985 | Locatelli et al. | 19/80 R |
| 4,638,445 | 1/1987 | Mattaboni | 364/513 |
| 4,707,887 | 11/1987 | Leifeld et al. | 19/80 R |
| 4,805,266 | 2/1989 | Leifeld et al. | 19/0.2 |
| 4,809,178 | 2/1989 | Ninomiya et al. | 364/461 |
| 4,839,943 | 6/1989 | Leifeld | 19/80 R |
| 4,954,962 | 9/1990 | Evans, Jr. et al. | 364/513 |
| 4,995,142 | 2/1991 | Binder et al. | 19/80 R |

FOREIGN PATENT DOCUMENTS

| | | | |
|---|---|---|---|
| 0192822 | 9/1986 | European Pat. Off. . | |
| 0221306 | 5/1987 | . | |
| 3320059 | 12/1983 | Fed. Rep. of Germany . | |
| 3644535 | 7/1988 | Fed. Rep. of Germany . | |
| 3719369 | 12/1988 | Fed. Rep. of Germany | 414/275 |
| 199111 | 9/1986 | Japan | 364/461 |
| 47806 | 2/1988 | Japan | 364/461 |
| 314622 | 12/1988 | Japan | 364/461 |
| 1468895 | 3/1977 | United Kingdom . | |
| 2166865 | 5/1986 | United Kingdom . | |

*Primary Examiner*—Jesus D. Sotelo
*Assistant Examiner*—Stephen P. Avila
*Attorney, Agent, or Firm*—Spencer & Frank

[57] ABSTRACT

A method of operating a fiber bale opener (which has a tower arranged for travel along a series of fiber bales and an opening device carried by the tower and movable vertically relative thereto) includes the steps of moving the opening device back and forth along top surfaces of the fiber bales; removing fiber tufts by the opening device during travel thereof; coordinating travelling motions of the bale opener with vertical motions of the opening device by a control device; determining the presence of a foreign body in the fiber bales; lifting, during each pass of the bale opener, the opening device off the fiber bales just ahead of the location; moving the opening device, in the course of the travel thereof, over the foreign body; and lowering the opening device, in the course of the travel thereof, onto the fiber bales after passing over the foreign body.

2 Claims, 2 Drawing Sheets

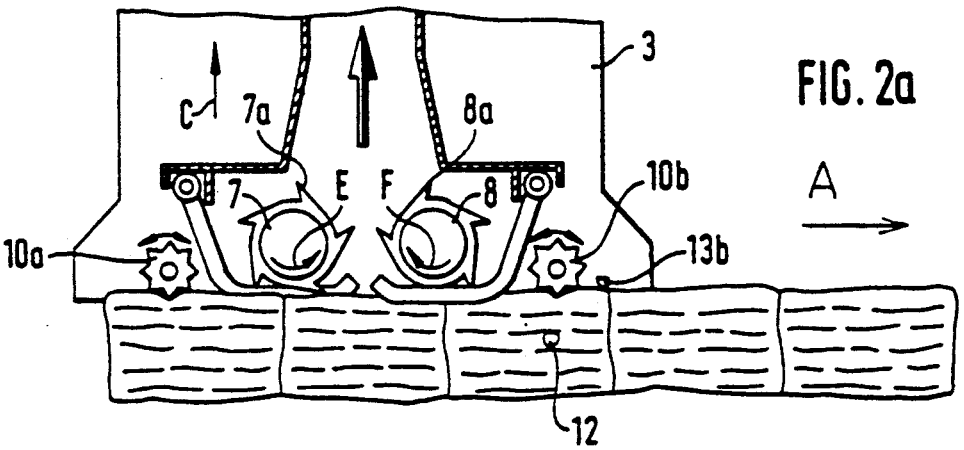
FIG. 2a
FIG. 2b
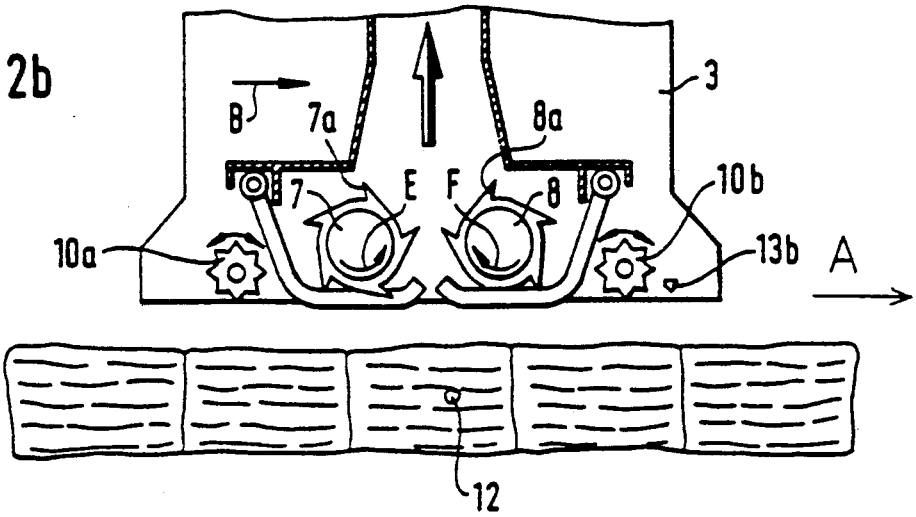
FIG. 2c
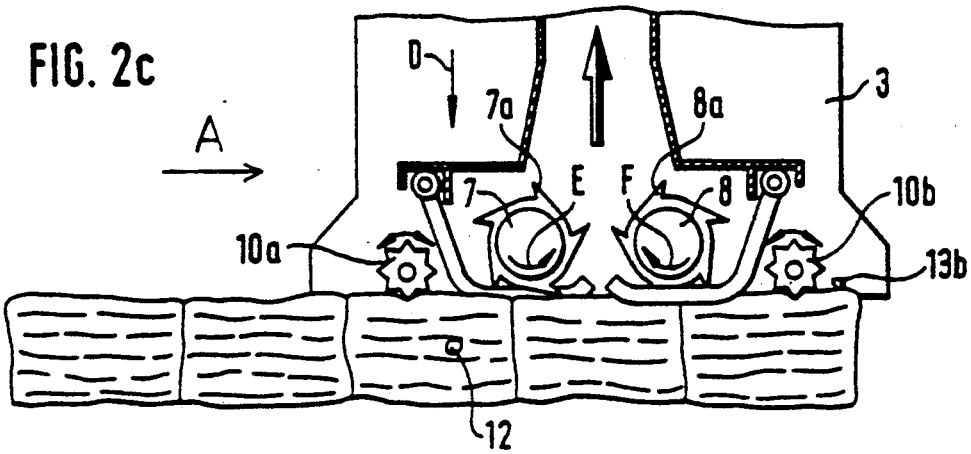

METHOD OF OPENING FIBER BALES

CROSS REFERENCE TO RELATED APPLICATION

This application claims the priority of Federal Republic of Germany Application P 39 36 079.2 filed Oct. 30th, 1989, which is incorporated herein by reference.

BACKGROUND OF THE INVENTION

This invention relates to a method and an apparatus for removing fiber tufts from the surface of fiber bales such as cotton fiber bales, chemical fiber bales or the like. The apparatus has a tower which travels, by means of a carriage, along the fiber bales and on which there is mounted the opening device proper to remove the fiber tufts from the fiber bale surface. The opening device is movable vertically with respect to the tower; its vertical motion and the travelling motion of the tower are coordinated with one another by a control device. There is further provided a sensor device which detects foreign bodies, such as metal or wood fragments, foil particles, foreign fibers and the like contained in the fiber bales.

Risks are high that fiber bales contain foreign bodies, such as metal strap fragments, wire pieces, tools and the like. Such foreign bodies may cause damages in the textile machinery as early as the first processing step, that is, they may damage the bale opener in the course of the fiber bale opening process. Such foreign bodies may even cause a fire in the bale opener or the downstream-arranged fiber processing machines or such undesired foreign parts may gain access to subsequent fiber processing machinery.

Further, it is feasible that undesirable foreign fibers are contained in the cotton fiber bales and/or chemical fiber bales; such foreign fibers adversely affect the yarns, particularly the high-quality yarns. Such foreign fibers often remain in the cleaning and spinning installations in the useful fiber material during fiber processing and disadvantageously lead to discolorations. In many instances such impurities consist of jute, hemp or polypropylene fragments. The foreign fibers originate mostly from the packaging and from sacks which are used during harvesting. Foreign fibers, tying strings and the like are thus often present in the compressed fiber bales. The pressed-in tying strings often extend through several fiber layers (zones) in the fiber bale so that the bales often have to be dug into by hand to a substantial depth until the entire length of the foreign material can be removed. Such a foreign material removal is substantially labor-intensive and adversely affects the continuing work process.

In a known process for opening fiber bales, a sensor system recognizes foreign bodies (such as metal or wood fragments, sheet particles or foreign fibers), whereupon the fiber processing machine is immediately stopped and the foreign body is manually removed. The immediate stoppage of operation disadvantageously leads to a down time of the entire fiber processing line since substantial time is needed until maintenance personnel attend to the problem of removing the foreign body from the time the alarm signal or stoppage signal has been triggered. This procedure disadvantageously caused a significant reduction in output.

SUMMARY OF THE INVENTION

It is an object of the invention to provide an improved method and apparatus of the above-outlined type from which the discussed disadvantages are eliminated and which, in particular, allows a continuing operation after the detection of a foreign body.

This object and others to become apparent as the specification progresses, are accomplished by the invention, according to which, briefly stated, the opening device is, during each working pass, lifted off the bale in front of the foreign body, moved thereover and subsequently lowered onto the fiber bale to resume the fiber tuft-detaching operation behind the foreign body.

By virtue of the fact that, according to the invention, the location of the foreign body (height, location of the bale in the bale series as well as location as viewed over the width of the opening device) is stored in the control apparatus, the location is displayed and an alarm signal is triggered, the opening device is so controlled that during the course of its normal travel it is lifted off the fiber bale in the zone of the foreign body, it continues its travel without detaching any fiber tufts and then it is lowered to resume the normal fiber removing operation. Such an operation continues until maintenance personnel manually intervene by removing the foreign body (combined with raking, if expedient), whereupon the normal automatic operation may resume.

Expediently, the location of the foreign body is recorded in a memory which is connected with the control device of the fiber bale opener.

In the apparatus for performing the method according to the invention, the sensor for detecting the foreign bodies, the drive motor for the tower of the bale opener, the lifting and lowering motor for the opening device and a memory are connected with the control device by means of control cables. Preferably, a display device is provided which is connected to the control device. According to a further feature of the invention, an alarm device is coupled to the control device.

BRIEF DESCRIPTION OF THE DRAWING

FIGS. 2*a*, 2*b* and 2*c* are schematic side elevational views of the preferred embodiment, illustrating different operational positions thereof.

DESCRIPTION OF THE PREFERRED EMBODIMENT

Figure 1:
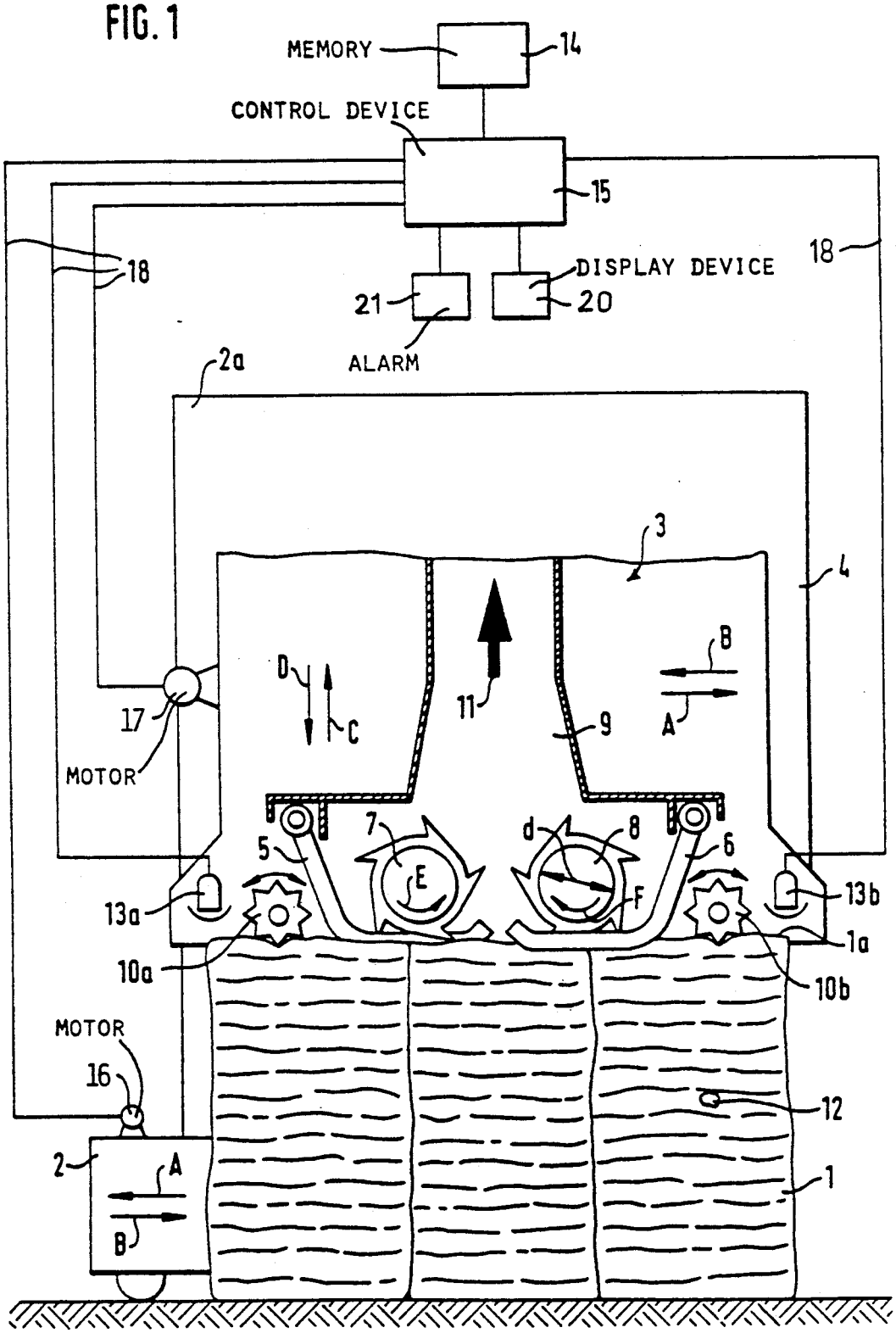
FIG. 1 is a schematic side elevational view, with block diagram, of a preferred embodiment of the invention.

Turning to FIG. 1, there is schematically illustrated a bale opener which may be, for example, a BLENDOMAT model, manufactured by Trützschler GmbH & Co. KG, Mönchengladbach, Federal Republic of Germany. The fiber bale opener has a carriage 2 which travels back and forth in the direction of the arrows A, B along a series of free-standing fiber bales 1. The carriage 2 supports a tower 2*a* which, in turn, supports an opening device 3. The latter includes a housing 4, two grates 5 and 6, two opening rolls 7 and 8 mounted in the housing and cooperating with a respective grate 5 and 6. The direction of rotation of the opening rolls 7 and 8 is designated with arrows E, F. Within the housing 4, above the opening rolls 7, 8, there is arranged a suction hood 9 through which a suction air stream 11 passes for carrying away fiber tufts detached by the opening rolls 7 and 8 as the fiber bale opener travels along the series of free-standing fiber bales 1.

The grates 5 and 6 extend between axially spaced teeth of the respective opening rolls 7 and 8 and press down on the upper face of the fiber bales and thus stabilize the same. Further, the grates 5, 6 prevent the fiber layers in the fiber bales from being torn out or shifted by the opening rolls 7, 8.

The two opening rolls 7 and 8 are flanked by pressing rolls 10*a* and 10*b* which are also supported in the housing 4 and which are oriented axially parallel to the opening rolls 7 and 8. The pressing rolls 10*a* and 10*b* engage and press down on the upper face la of the fiber bales 1. By means of this arrangement and by virtue of the fact that the teeth of the pressing rolls 10*a* and 10*b* penetrate into the top of the fiber bales 1, the latter are maintained in position and thus prevented from shifting or tipping over.

During operation, the opening rolls 7 and 8 of the bale opener travel back and forth along the fiber bale series, above the top face 1*a* of the fiber bales while the teeth of the opening rolls 7 and 8 penetrate into the fiber bales through the gaps between the grate bars of each grate 5 and 6. The fiber tufts torn from the fiber bales by the opening rolls 7 and 8 are thrown by the opening rolls towards one another and upwardly so that they are entrained by the suction stream 11 and are thus carried away in the suction hood 9. After the completion of each pass, the opening device is incrementally lowered relative to the tower 2*a* in the direction of the arrow D.

A foreign body 12, such as a metal fragment, may be deeply embedded into one of the fiber bales 1. In front of and behind the pressing rolls 10*a*, 10*b* sensors 13*a* and 13*b* are arranged. These sensors may be inductive sensors for metal components or sensors for non-metallic foreign bodies, for detecting the presence of the foreign body 12. The sensors 13*a*, 13*b* are connected to a control device 15 (such as a microcomputer including a microprocessor) for controlling the operation of the fiber bale opener. Further, to the control device 15 there are connected the drive motor 16 for the carriage 2, the lifting motor 17 for the opening device 3 and a memory 14 for storing information concerning the location of the foreign body 12. Further, a display device 20 and an alarm device 21 are connected with the control device 15. The cables connecting the drive motors 16, 17 as well as the sensors 13*a*, 13*b* with the control device 15 are designated at 18.

In operation, the carriage 2 travels with the tower 2*a* and the cantilevered opening device 3, for example, in the direction of the arrow A, as shown in FIG. 2*a*. Upon a determination of the presence of the foreign body 12 by the sensor 13*b* an electric signal is transmitted to the control device 15. At the same time, a location sensor which forms part of the drive motor 16 and which is capable of reporting the position of the drive motor 16 along its path of travel is triggered, whereby information on the location of the foreign body 12 along the path of travel is inputted in the memory 14.

Thereafter, as shown in FIG. 2*b*, the opening device 3 is raised in the direction of the arrow C off the bale surface 1*a* by means of the lifting motor 17 and thus the carriage 2, together with the tower 2*a* and the opening device 3, travels in the direction of the arrow B through a distance until at least the opening rolls 7 and 8 but preferably the pressing roll 10*a* has passed the zone of the foreign body 12, that is, until the opening device 3 has, in the working direction A, passed the location of the foreign body 12.

In a subsequent operational step the opening device 3 is lowered in the direction of the arrow D by the lifting motor 17 onto the bale face la, as shown in FIG. 2*c*. Thereafter, the carriage 2, together with the tower 2*a* and the opening device 3 continues its travel in the direction B and thus continues its normal fiber tuft detaching operation.

It will be understood that the above description of the present invention is susceptible to various modifications, changes and adaptations, and the same are intended to be comprehended within the meaning and range of equivalents of the appended claims.

What is claimed is:

1. In a method of operating a fiber bale opener having a tower arranged for travel along a series of fiber bales and an opening device carried by the tower and movable vertically relative thereto; the opening device including opening roll means for penetrating into the fiber bales to remove fiber tufts therefrom; including the steps of moving the opening device back and forth along top surfaces of the fiber bales; removing fiber tufts by the opening device during travel thereof; coordinating travelling motions of the bale opener with vertical motions of the opening device by a control device and determining the presence of a foreign body occupying a location in the fiber bales; the improvement comprising the following consecutive steps:

(a) lifting, during each pass of the bale opener, the opening device off the fiber bales just ahead of said location;

(b) moving the opening device, in the course of the travel thereof, over the foreign body; and (c) lowering the opening device, in the course of the travel thereof, onto the fiber bales after passing over the foreign body.

2. A method as defined in claim 1, further comprising the steps of determining the location of the foreign body and storing information in the control device relating to said location.

* * * * *